US005545018A

United States Patent [19]

Sundberg

[11] Patent Number: 5,545,018

[45] Date of Patent: Aug. 13, 1996

[54] VARIABLE DISPLACEMENT VANE PUMP HAVING FLOATING RING SEAL

[75] Inventor: Jack G. Sundberg, Meriden, Conn.

[73] Assignee: Coltec Industries Inc., New York, N.Y.

[21] Appl. No.: 427,774

[22] Filed: Apr. 25, 1995

[51] Int. Cl.[6] ..... F01C 21/16

[52] U.S. Cl. ..... 418/30; 418/104

[58] Field of Search ..... 418/30, 31, 104

[56] References Cited

U.S. PATENT DOCUMENTS 3,549,281 12/1970 Schink et al. ..... 418/31

4,678,412 7/1987 Dautlgraber ..... 418/31

4,950,137 8/1990 Fischer et al. ..... 418/30

*Primary Examiner*—Charles Freay

*Attorney, Agent, or Firm*—Howard S. Reiter

[57] ABSTRACT

A pump comprising a durable rotor member having large diameter journal ends at each side of a central vane section comprising vane slots having well areas which slidably-engage a mating vane element. The present vane pumps comprise novel cylindrical floating ring seal elements having a support body which continuously seals the face of the cam member, and have a movable inner ring assembly which becomes pressure-loaded against the rotor journals during use, to minimize or limit axial pressure leakage while balancing or minimizing bearing load.

14 Claims, 3 Drawing Sheets

VARIABLE DISPLACEMENT VANE PUMP HAVING FLOATING RING SEAL

BACKGROUND OF THE INVENTION

1. Field of the Invention

The present invention relates to single acting, variable displacement fluid pressure vane pumps and motors for aircraft use, component parts thereof and to a method for balancing fluid pressures.

Over the years, the standard of the commercial aviation gas turbine industry for main engine fuel pumps has been a single element, pressure-loaded, involute gear stage charged with a centrifugal boost stage. Such gear pumps are simple and extremely durable, although heavy and inefficient. However, such gear pumps are fixed displacement pumps which deliver uniform amounts of fluid, such as fuel, under all operating conditions. Certain operating conditions require different volumes of liquid, and it is desirable and/or necessary to vary the liquid supply, by means such as bypass systems which can cause overheating of the fuel or hydraulic fluid and which require heat transfer cooling components that add to the cost and the weight of the system.

2. State of the Art

Vane pumps and systems have been developed in order to overcome some of the deficiencies of gear pumps, and reference is made to the following U.S. Pat. Nos. for their disclosures of several such pumps and systems: 4,247,263; 4,354,809; 4,529,361 and 4,711,619. Reference is also made to copending commonly-owned application U.S. Ser. No. 08/114253, filed Aug. 30, 1993, the disclosure of which is hereby incorporated herein.

Vane pumps comprise a rotor element machined with slots supporting radially-movable vane elements, mounted within a cam member and manifold having fluid inlet and outlet ports in the cam surface through which the fluid is fed to the low pressure inlet areas or buckets of the rotor surface for rotation, compression and discharge from the high pressure outlet areas or buckets of the rotor surface as pressurized fluid.

Vane pumps that are required to operate at high speeds and pressures preferably employ hydrostatically (pressure balanced) vanes for minimizing frictional wear. Such pumps may also include rounded vane tips to reduce vane-to-cam surface stresses. Examples of vane pumps having pressure-balanced vanes which are also adapted to provide undervane pumping, may be found in the aforementioned copending application and in U.S. Pat. Nos. 3,711,227 and 4,354,809. The latter patent discloses a vane pump incorporating undervane pumping wherein the vanes are hydraulically balanced in not only the inlet and discharge areas but also in the seal arcs whereby the resultant pressure forces on a vane cannot displace it from engagement with a seal arc.

Variable displacement vane pumps contain a swing cam element which is adjustable or pivotable, relative to the rotor element, in order to change the relative volumes of the inlet and outlet or discharge buckets and thereby vary the displacement capacity of the pump.

In conventional single acting vane pumps the rotor is splined upon and driven by a central drive shaft having small diameter journal ends which are not strong enough to withstand the opposed inlet and outlet hydraulic pressure forces generated during normal operation. This problem is overcome by forming such pumps as double-acting pumps having opposed inlet arcs and opposed outlet or discharge arcs which balance the forces exerted upon the journal ends, as disclosed by the prior art such as U.S. Pat. Nos. 4,354,809 and 4,529,361, for example.

Among the disadvantages of the latter known vane pumps is the necessity of two inlet arcs and two discharge arcs as compared to single acting pumps which have a single inlet arc and a single outlet arc. The shorter inlet arcs of dual-acting pumps requires that the vanes be pressure-loaded in the area of the inlet arc in order to cause the vane tip to track or maintain continuous contact with the cam surface. This results in higher vane-to-cam stresses and eliminates use of undervane pumping. The dual pump arcs also introduce leakage areas, which require side plates or end sealing plates to seal the ends of the rotor and the cam faces for the purpose of containing the pressurized fluid and avoid the creation of a high pressure gradient along the entire length of the rotor element and its journal ends. The present invention is concerned with improvements in such side plates or end sealing plates to produce vane pumps having improved efficiency and performance while reducing pressure loads exerted against the rotor in the pressure discharge direction.

SUMMARY OF THE INVENTION

The present invention relates to novel single acting, variable displacement vane pumps, and components thereof, which have the durability, ruggedness and simplicity of conventional gear pumps, and the versatility and variable metering properties of vane pumps, while incorporating novel cylindrical floating ring seal assemblies which are pressure responsive to seal and confine the high pressure within the cam member and prevent pressure leakage along the length of the rotor member.

The novel pumps of the present invention comprise a durable, substantially uniform-diameter rotor member which is machined from barstock, in manner and appearance similar to the main pumping gear of a gear pump, so as to have large diameter journal ends at each side of a central vane section comprising a plurality of axially-elongated radial vane slots, well areas of each vane slot slidably-engaging a mating vane element. An adjustable narrow cam member having a continuous circular inner cam surface eccentrically surrounds and encloses the central vane section, and the cam surface is engaged by the outer surfaces or tips of the vane elements during operation of the pump. The journal ends of the rotor member are rotatably-supported within opposed durable bearings, which have faces which confine the present cylindrical floating ring seals between themselves and the opposed faces of the cam member. During rotation of the journals of the vaned rotor member within the bearings and rotation of the central vane section of the rotor member within the cam member, fluid such as liquid fuel is admitted at low pressure to the inlet arc segment of the cam chamber, through inlet passages at the interfaces of the cam member and each of the floating ring seals, and into expanding inlet bucket chambers between the vanes, and also through the vane slot extensions to undervane chambers. Continued rotation of the rotor member through a sealing arc segment into a discharge arc segment reduces the volume of the bucket areas and changes the pressure acting upon the leading face of each vane from low inlet pressure to increasing discharge pressure as the volume of each bucket chamber is gradually compressed at the discharge side or arc of the eccentric cam chamber. The pressurized fuel escapes through discharge passages in each seal and bearing, and is channelled to its desired destination.

The novel vane pumps of the present invention also provide substantial undervane pumping of the fluid from the undervane slot areas by piston action as the vanes are depressed into the slots at the discharge side of the cam chamber. Such undervane pumping can contribute up to 40% or more of the total fluid displacement.

The essential novelty of the vane pumps of the present invention resides in the novel cylindrical floating ring seal elements, each of which has a support body which continuously seals a face side of the cam member, and a concentric movable ring member which becomes pressure-loaded against one of the rotor journals in a direction radially-inwardly or downwardly from the pressure discharge area of the cam chamber to minimize or limit pressure leakage while balancing or minimizing bearing load.

The present ring seal elements are annular elements comprising an annular outer support housing, a floating annular concentric inner rotor-seal ring bearing assembly movably-retained within a recess in the inside face of the support body for pressure-movement radially-inward against the rotor journal, a spaced pair of sealing pins axially-supported within the support body of the ring seal element to define a pressurized fuel discharge area on the outer diameter surface of the floating ring, which results in a net sealing force against the rotor journal. The pins are spring loaded or biased to establish initial sealing against the outer surface of the inner ring seal and to enable pressurization-of the fuel discharge area during operation.

The end result is to provide a floating ring seal since the ring seal assembly is loosely retained within a radial space between the support body and the rotor journal and comprises as the inner diameter surface thereof a carbon composition bearing which provides an axial seal along the bearing journals. Thus, the ring seal assembly is movable radially-inwardly from the discharge arc by the high discharge pressure of the pump exerted into the recess area between the movable sealing pins, causing the pins to be forced radially-inwardly against the outer surface of the ring seal assembly and form a circumferentially-closed pressurized recess in the area between the pins, which recess is a discharge passage for conveying fuel pumped from the vane bucket areas, through fuel passages in the adjacent bearings, to the engine. The fuel-pressurized recess exerts pressure against the outer diameter of the floating ring seal assembly to urge the carbon composition bearing against the rotor journal whereby the journals are sealed against axial leakage and loss of pressure from the cam element.

DETAILED DESCRIPTION

Figure 1:
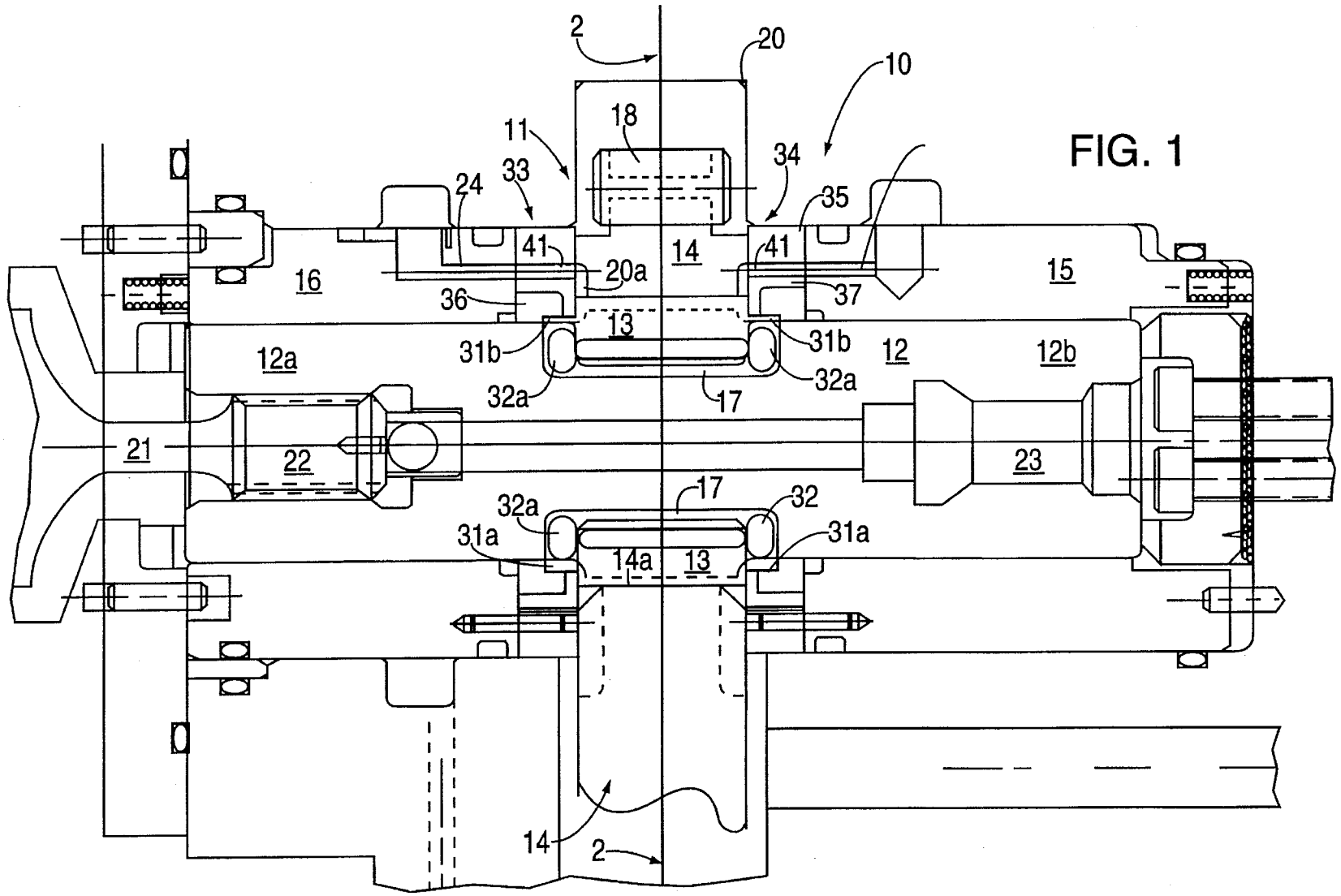
FIG. 1 is a schematic cross-sectional view of a fuel pump assembly according to one embodiment of the present invention.

Referring to FIG. 1, the fuel pump assembly 10 thereof comprises a variable displacement single acting vane pump 11 having a rugged barstock rotor member 12 having a plurality of vane elements 13 radially-supported within axially-elongated, vane slots 32 disposed around the central pumping area of the rotor member 12. The outer tips of the vane elements 13 preferably are rounded to reduce their contact stresses with the interior continuous surface 14*a* (FIG. 2) of an adjustable cam member 14 having a chamber, and a pair of bearing members 15 and 16 which rotatably support the large diameter journal ends 12*a* and 12*b* of the rotor member 12 and confine between themselves and the opposed faces of the cam member 14 an opposed pair of cylindrical floating ring seal elements 33 and 34 which provide axial sealing of the pressurized chamber.

The vane pump 11 is fed with fluid such as liquid fuel from a source such as a centrifugal boost stage into a plenum around the main vane stage cam and axially into the expanding inlet vane buckets 29.

Power is extracted in conventional manner from an engine through a main drive shaft 21 which includes and oil-lubricated main drive spline and a fuel-lubricated internal drive spline 22. A second shaft 23 drives the boost stage from a spline on the journal end 12*b*.

The pump is mounted to the main engine gearbox, and bearing passages 24 and 25 provide passages through the bearing members 15 and 16 and through the seal members 33 and 34 to provide an outlet from the vane pump. A boost stage provides charging pressure to the inlet arc section 27 of the cam member 14 for introduction of the fuel, through slots 28 on the opposed faces of the cam member and into the expanding fuel inlet arc section of the cam member 14, as shown in FIG. 2.

Figure 2:
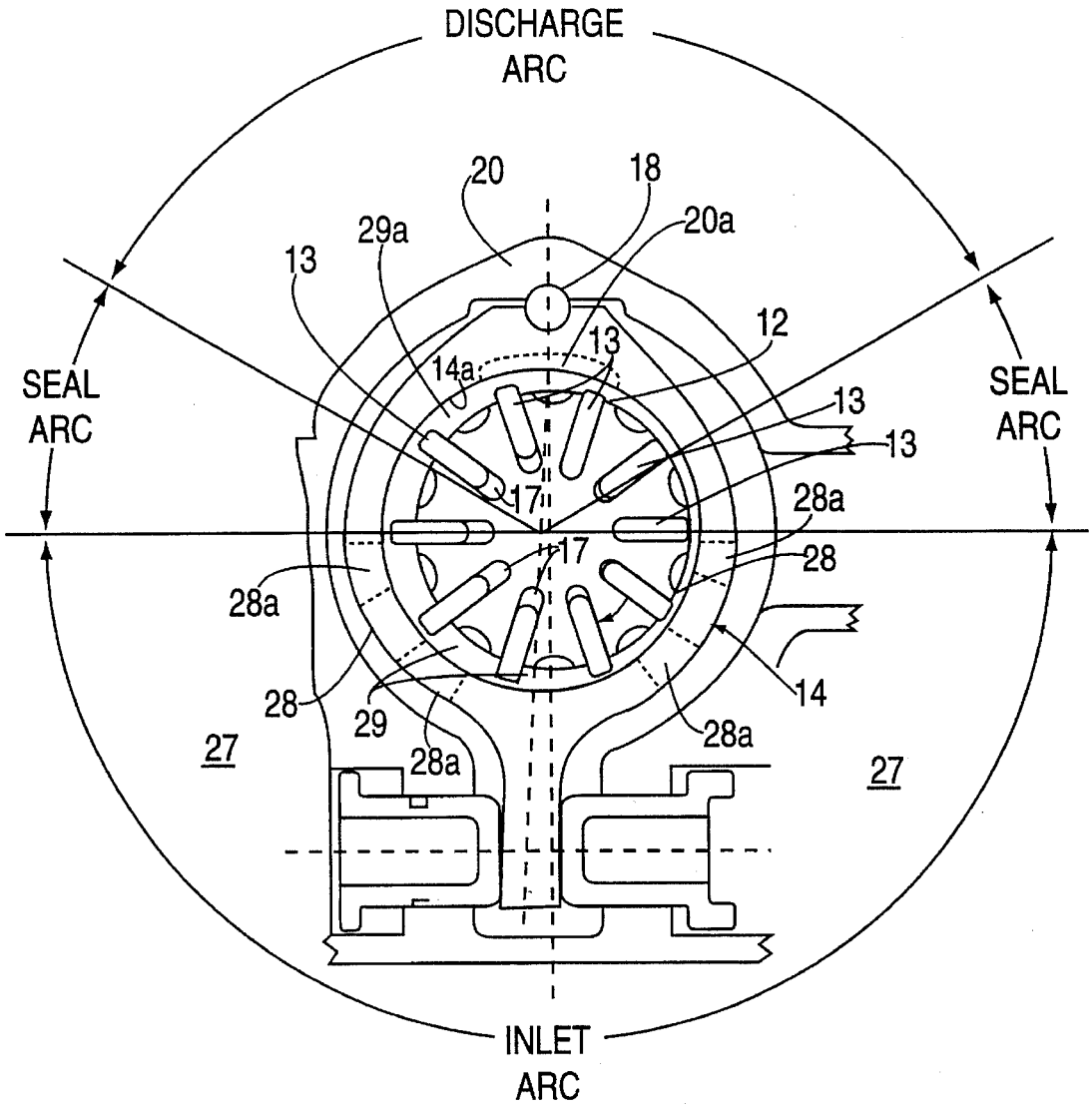
FIG. 2 is a schematic cross-sectional view of the single acting vane stage of FIG. 1 taken along the line 2—2 thereof.

Rotation of the rotor 12 and vanes 13 within the cam member 14 causes the inlet buckets 29 to move into a seal arc area where they become isolated from the inlet arc section 27 and begin to become compressed due to the non-concentric axial position of the rotor member 12 within the cam chamber, as shown in FIG. 2. Within the seal arc zones, which are transition zones between the lower-pressurized inlet pressure zones and the increased discharged pressure zone, each vane experiences a different overvane pressure on each side of it, which normally can cause intermediate overvane forces. However, the present pumps provide special pressure relief passages to a source of fluid at intermediate pressure in the seal arc areas as is more disclosed and explained in copending, commonly owned application Ser. No. 08/114,253, filed Aug. 30, 1993, which has been incorporated herein by reference.

FIG. 2 is a simplified depiction of a cam member mechanism adjustable between minimum and maximum displacement flow positions. The cam 14 pivots on a pin 18 supported within housing section 20 at the top of the pump structure member. The pump is at maximum displacement when the cam 14 is positioned so that the vane buckets experience maximum contraction in the discharge arc zone. Likewise, minimum flow occurs when the cam 14 and the rotor 12 are almost concentric. Mechanical stops are designed into a piston adjustment system to limit cam displacement, generally, for the purpose of assuring that the cam will not contact the rotor surface (Exceeds max displacement). These stops include shims for final production calibration.

Fuel enters around the main vane stage cam 14 in the inlet arc zone 27 through radial inlet grooves 28*a* in the cam face and is admitted, axially, to the expanding inlet vane buckets 29 through an undercut slot 28 on each cam face from face recesses or grooves 28*a* on both sides of the cam 14, adjacent the sealing ring assemblies 34 and 33. Each vane bucket 29 then carries the fuel circumferentially into the discharge arc where contracting discharge buckets 29*a* squeeze the fuel axially outward into discharge passages or recess areas 41 of the seal assemblies 33 and 34 and through discharge passages 24 and 25 in the bearings 15 and 16.

It will be apparent from the foregoing, particularly FIG. 2, that the rotor member 12 and its journal ends 12*a* and 12*b* are exposed to high discharge pressures in the area of the discharge arc of rotation of the rotor, which would normally cause the fuel to leak or escape axially between the outer surface of the rotor journals 12*a* and 12*b* and the inner surface of the seal assemblies 33 and 34 within which it rotates. Such pressures tend to apply a radially-outward force against the seal assemblies 33 and 34 in the area of the discharge arc, increasing leakage, and a corresponding radially-inward force against the rotor 12 in the area of the inlet arc 27, increasing friction and wear.

Figure 3:
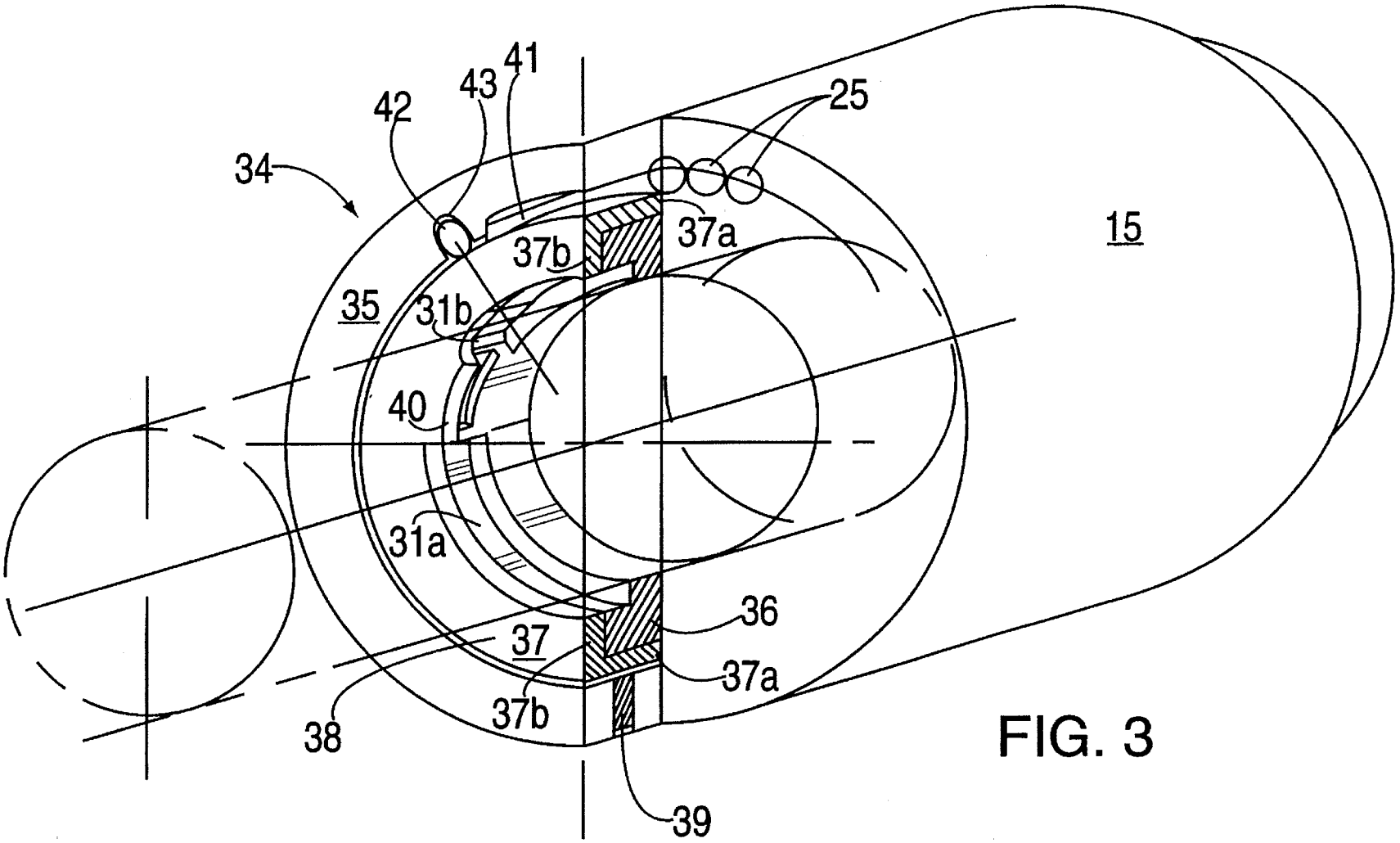
FIG. 3 is a cross-sectional perspective view of a cylindrical floating ring seal assembly and an associated bearing, according to the present invention.

These problems are avoided by the novel cylindrical floating ring seal assemblies 33 and 34 of the present invention, 34 being illustrated in greater detail in FIG. 3 of the drawings. The assembly 34 of FIG. 3 is shown in half-section, the other cut-away section being the identical mirror-reverse of the illustrated section. Each seal assembly 33 or 34 comprises an annular outer support housing 35, such as of steel, which is designed to be compressed axially between a bearing 15 or 16 and a face of the cam member 14 to seal the cam chamber except in the area of the fuel inlet grooves 28*a* in the cam faces, shown in FIG. 2. The housing 35 loosely supports an inner diameter bearing ring assembly 38 consisting of surface material 36, such as of carbon composition, contained within a steel support ring 37 which is interference-fitted within the outer housing 35 for radial movement relative thereto, and within which the rotor surface rotates. The ring seal assembly 38 is restrained against relative rotation by means of a radial pin 39. Support ring 37 comprises a cylindrical hub portion 37*a* and an annular radial flange portion 37*b* having an inner diameter surface 40. The recess areas 31*b* adjacent to the rotor journals are open to rotor vane slot ends 32*a* to provide passage from the under vane areas 17 to a cam surface recess 20*a* communicating with the overvane areas. Ring seal passage 41 provides discharge of fluid fuel from the cam chamber to the bearing passages 24 and 25 to the engine. The seal assembly 38 is free to be moved radially a slight distance, within the diametral clearance, relative to its housing 35, in order to more tightly engage the inner diameter of surface material 36 with the upper surface of the journal end of the rotor 12 in the high pressure discharge arc area of the cam chamber, to prevent or reduce axial leakage along the rotor journals 12*a* and 12*b*, and to be free to exert a downward pressure against the rotor surface which balances and neutralizes the upward pressure exerted between the rotor surface and the seal ring assembly 36, 38 in the area of the discharge arc.

The downward movement of the floating ring seal assembly 38 is produced by providing the high pressure flow passage area 41 at the interface of the fixed outer housing 35, and the seal assembly 38, passage 41 being open to receive high pressure liquid at the discharge arc of the cam chamber.

The housing 35 is also provided with a spaced pair of spring loaded seal pins 42 for initial sealing load, each supported within a slot 43 in the housing 35. Pins 42 seal the chamber 41 from the remainder of diametral clearance. This pressurized area is larger than the blow off load moving the ring seal assembly 38, against the upper surface of the rotor 12, to prevent leakage and reduce the load on the bearings.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A durable vane pump comprising:

(a) a cylindrical rotor member having journal ends and a central vane section comprising a plurality of radial vane slots uniformly spaced around the central circumference thereof, said vane slots being elongate in the axial direction and each having a vane-supporting portion;

(b) a plurality of vane elements each having a pair of substantially parallel axially spaced-apart edges, and each slidably-engaged within the vane-supporting portion of a said vane slot for radial movement therewithin;

(c) a unitary cam member having opposed faces and a bore therethrough forming a cam chamber having a continuous interior cam surface, the central vane section of said rotor member being supported axially and non-concentrically within said cam chamber so that the outer tip surfaces of all of the vane elements make contact with said continuous interior cam surface during rotation of said rotor member between a low pressure fuel inlet arc segment and a high pressure fuel outlet arc segment of said cam chamber;

(d) an opposed pair of bearings rotatably supporting the journal ends of said rotor member; and (e) an opposed pair of cylindrical floating ring seal elements, one each between a face of a said bearing and a face of said cam member, each said seal element having an annular outer support housing having a radial face surface which engages a face surface of said cam member, and encloses the central vane-supporting portion of said rotor member within said cam chamber, and an inner annular ring seal assembly movably supported within said support housing adjacent the said edges of said vanes, and having an inner bearing surface for the journals of the rotor member, each seal assembly comprising an inlet arc segment communicating with a fuel inlet for admitting fuel to expanded vane bucket areas of the rotating vaned rotor, and a discharge arc segment containing outlet means for discharging pressurized fuel from contracting vane rotor areas as the vanes are depressed into the vane slots during rotation through the discharge arc, the discharge arc segment of said ring seal assembly comprising a fuel outlet passage at the interface of said outer support housing and said inner ring seal assembly responsive to the high discharge arc pressure, for urging the inner ring seal assembly radially inwardly against the surface of the rotor journal to prevent axial fuel leakage along the surface of the rotor journals and balance the pressures acting upon the rotor.

2. A pump according to claim 1 in which the fuel outlet passage in the discharge arc segment of each seal element comprises a recess in the inner diameter of the outer support housing, and an opposed pair of movable sealing pins mounted within the outer support housing, one at each side of said recess, which move against the upper surface of the ring seal assembly to seal said recess at said interface, the pressurization of said recess exerting a downward radial pressure of the assembly against the rotor journal.

3. A pump according to claim 1 in which the fuel inlet comprises one or more grooves in the opposed faces of the cam member, adjacent a radial face surface of a said ring seal element to admit fuel therebetween to the cam chamber.

4. A pump according to claim 1 in which the inner bearing surface of said inner annular ring seal assembly comprises a bearing ring of carbon composition which is the only area of said seal assembly which contacts said rotor surface.

5. A pump according to claim 4 in which each said bearing ring is recessed inwardly from a face surface of each of said inner ring seal assembly to provide a fuel inlet recess which communicates with the fuel inlet grooves and with the vane slot extensions.

6. A pump according to claim 1 in which each said vane slot comprises extensions which communicate with under-vane areas of said rotor member.

7. A pump according to claim 1 in which each of said bearings comprise one or more fuel conduits which communicate with a fuel outlet passage of a floating ring seal element to convey pumped fuel to a downstream destination.

8. A pump according to claim 1 in which each of said bearings comprise one or more fuel conduits which communicate with a fuel outlet passage of a floating ring seal element to convey pumped fuel to a downstream destination.

9. A durable, single action, variable displacement vane pump capable of undervane pumping comprising:

(a) a cylindrical rotor member having journal ends and a central vane section comprising a plurality of radial vane slots uniformly spaced around the central circumference thereof, said vane slots being elongate in the axial direction and each having a central vane-supporting portion having slot extension portions at each end thereof;

(b) a plurality of vane elements each having a pair of substantially parallel axially spaced-apart edges, and each being slidably-engaged within the central vane-supporting portion of a said vane slot for radial movement therewithin;

(c) a unitary cam member having opposed faces and a bore therethrough forming a cam chamber having a continuous interior cam surface, the central vane section of said rotor member being supported axially and non-concentrically within said cam chamber so that the outer tip surfaces of all of the vane elements make continuous contact with said continuous interior cam surface during rotation of said rotor member between a low pressure fuel inlet arc segment and a high pressure fuel outlet arc segment, said slot extension portions projecting axially-outwardly beyond the faces of said cam member, and one or more grooves in the faces of said cam member comprising fuel inlet passages in the area of the fuel inlet arc segment, for admitting fuel to said cam chamber through said vane slot extension;

(d) an opposed pair of bearings rotatably supporting the journal ends of said rotor member; and (e) an opposed pair of cylindrical floating ring seal elements, one each between a face of a said bearing and a face of said cam member, and overlying said slot extension portions, each said seal element having an annular outer support housing having a radial face surface which sealingly engages a face surface of said cam member, except for said fuel inlet grooves, and encloses the central vane-supporting portion of said rotor member within said cam chamber, and an inner annular ring seal assembly movably supported within said support housing adjacent the said edges of said vanes, and having an inner bearing surface for the journals of the rotor member, each seal assembly comprising an inlet arc segment communicating with the fuel inlet grooves for admitting fuel to expanded vane bucket areas of the rotating vaned rotor, and a discharge arc segment containing outlet means for discharging pressurized fuel from contracting vane rotor areas as the vanes are depressed into the vane slots during rotation through the discharge arc, the discharge arc segment of said ring seal assembly comprising a fuel outlet passage at the interface of said outer support housing and said inner ring seal assembly responsive to the high discharge arc pressure, for urging the inner ring seal assembly radially inwardly against the surface of the rotor journal to prevent axial fuel leakage along the surface of the rotor journals and balance the pressures acting upon the rotor.

10. A pump according to claim 9 in which the fuel outlet passage in the discharge arc segment of each seal element comprises a recess in the inner diameter of the outer support housing, and an opposed pair of movable sealing pins mounted within the outer support housing, one at each side of said recess, which move against the upper surface of the ring seal assembly to seal said recess at said interface, the pressurization of said recess exerting a downward radial pressure of the assembly against the rotor journal.

11. A pump according to claim 9 in which the fuel inlet passages comprise a plurality grooves in the opposed faces of the cam member, adjacent a radial face surface of a said ring seal element to admit fuel therebetween to the vane slots and undervane areas of the rotor.

12. A pump according to claim 9 in which the inner bearing surface of said inner annular ring seal assembly comprises a bearing ring of carbon composition which is the only area of said seal assembly which contacts said rotor surface.

13. A pump according to claim 12 in which each said bearing ring is recessed inwardly from a face surface of each of said inner ring seal assembly to provide a fuel inlet recess which communicates with the fuel inlet passages and with the vane slot extensions.

14. A pump according to claim 9 in which said vane slot extension portions communicate with under-vane areas of said rotor member.

* * * * *